US005188304A

United States Patent [19]

Colli et al.

[11] Patent Number: 5,188,304

[45] Date of Patent: Feb. 23, 1993

[54] DEVICE AND PROCESS FOR THE HANDLING AND THE CONTROL OF THE THREAD ON A CONER MACHINE DURING THE OPERATION OF SPOOL CHANGE AND OF THREAD JOINING

[75] Inventors: Luigi Colli; Roberto Badiali, both of Pordenone, Italy

[73] Assignee: Savio S.p.A., Pordenone, Italy

[21] Appl. No.: 800,764

[22] Filed: Dec. 2, 1991

Related U.S. Application Data

[63] Continuation-in-part of Ser. No. 691,689, Apr. 25, 1991, abandoned, which is a continuation of Ser. No. 436,957, Nov. 15, 1989, abandoned, which is a continuation of Ser. No. 158,608, Feb. 22, 1988, abandoned.

[30] Foreign Application Priority Data

Feb. 27, 1987 [IT] Italy ..... 19511 A/87

[51] Int. Cl.[5] ..... B65H 54/22

[52] U.S. Cl. ..... 242/35.6 R

[58] Field of Search ..... 242/35.6 R, 35.5 R, 242/35.5 A, 18 R, 36

[56] References Cited

U.S. PATENT DOCUMENTS

| | | | |
|---|---|---|---|
| 2,733,870 | 2/1956 | Furst | 242/35.6 R |
| 2,769,599 | 11/1956 | Furst | 242/35.6 R |
| 3,031,149 | 4/1962 | Furst et al. | 242/35.6 R |
| 3,055,604 | 9/1962 | Pitts | 242/35.6 R |
| 3,077,312 | 2/1963 | Furst | 242/35.6 R |
| 3,081,045 | 3/1963 | Pitts et al. | 242/35.6 R |
| 3,165,275 | 1/1965 | Furst | 242/35.6 R X |
| 3,198,446 | 8/1965 | Furst et al. | 242/35.6 R |
| 3,304,015 | 2/1967 | Jenny | 242/35.6 R |
| 3,314,621 | 4/1967 | Bous | 242/35.6 R |
| 3,358,941 | 12/1967 | Jenny | 242/35.6 R X |
| 3,399,840 | 9/1968 | Hayashi et al. | 242/35.5 R |
| 3,776,479 | 12/1973 | Lutovsky et al. | 242/35.6 R |
| 3,834,634 | 9/1974 | Havlas et al. | 242/35.6 R |

FOREIGN PATENT DOCUMENTS

| | | |
|---|---|---|
| 912193 | 5/1954 | Fed. Rep. of Germany . |
| 920055 | 11/1954 | Fed. Rep. of Germany . |
| 2404035 | 8/1975 | Fed. Rep. of Germany . |
| 2543983 | 2/1976 | Fed. Rep. of Germany . |
| 2705080 | 8/1978 | Fed. Rep. of Germany . |
| 2824752 | 12/1979 | Fed. Rep. of Germany . |
| 3213631 | 10/1982 | Fed. Rep. of Germany . |
| 3241280 | 11/1982 | Fed. Rep. of Germany . |
| 441078 | 1/1968 | Switzerland . |

*Primary Examiner*—Stanley N. Gilreath
*Attorney, Agent, or Firm*—George P. Hoare, Jr.

[57] ABSTRACT

A device and process for handling and controlling thread and for rejoining separated thread on an automatic coning machine. The device and process detects any faulty lengths on the thread fed from a feeding spool to a cone wound upon a tube and cuts the thread and rejoins the free ends of the thread. The device has a nozzle which moves in a direction substantially transverse the thread path and has a rest position and two operative positions on opposite sides of the thread path.

11 Claims, 12 Drawing Sheets

78
79
9
77
80
79
9
77
78
66
65
67
55
56
57
54
50
52
7
51
44
42
41
43
6
45
58
68
81
47
46
59
69
82

DEVICE AND PROCESS FOR THE HANDLING AND THE CONTROL OF THE THREAD ON A CONER MACHINE DURING THE OPERATION OF SPOOL CHANGE AND OF THREAD JOINING

This application is a continuation-in-part application of U.S. patent application Ser. No. 07/691,689 filed Apr. 25, 1991, now abandoned, which is, in turn, a continuation of U.S. patent application Ser. No. 07/436,957 filed Nov. 15, 1989, now abandoned, which is, in turn, a continuation of U.S. patent application Ser. No. 07/158,608 filed Feb. 22, 1988, now abandoned.

The object of the present invention is a device and a process for the handling and the control of the thread on an automatic coning machine, in particular during the operations of changing the feed spool and the restoring of the continuity of the thread by joining or knotting.

The coning operation consists in transferring the thread from a feeding spool to a cone wound up on a tube, detecting the defects thereof and removing any faulty lengths from it, by cutting them and knotting the free ends thereof.

The handling and control of the thread submitted to the coning is accomplished by means of various equipment pieces which the same thread meets according to a precise sequence along its route in the space, and which perform their action according to a sequence in time.

In the prior art many possible arrangements are reported for such equipment pieces, commonly denominated as "thread route", in which both the composition of the set of equipment pieces which the thread meets in running along its route from the spool to the cone, and the sequential order according to which they are arranged vary.

The composition and the order of such sequence of pieces of equipment vary according to the productive choices, which tend to privilege some requirements of the operation, on the basis of different compromises between the various requirements.

DOS 2,404,035 discloses a technical solution aiming at preventing that on the cone slack turns may be wound after a new start up following a thread joining. Such a purpose is achieved by inserting along the thread route an auxiliary thread tensioner, interposed between the knotting device and the cone drive cylinder, which is actuated during the start up only. In such a way, the formation of a loop of thread inside the knotting device—which is responsible for the above said slack turns—is prevented.

DOS 2,824,752 discloses a technical solution aiming at preventing that the slub catcher, after the breakage of the thread, may continue to detect the presence of the thread, by being occupied by a free end of the thread, or by a piece of the broken thread.

In such case, the cycle of restoration of thread continuity is not begun.

Such a technical solution consists in placing, between the thread tensioner, on the same side of the spool, and the same slub catcher, an air suction nozzle, which is movable, and with an air stream moving out of the thread route. Such an air suction nozzle cooperates with a cutting device provided between it and the slub catcher, in order to remove the free thread end, or the thread length present inside the slub catcher.

Such nozzle ends its task before the joining of the thread and does not control the joined thread.

Figure 1A:
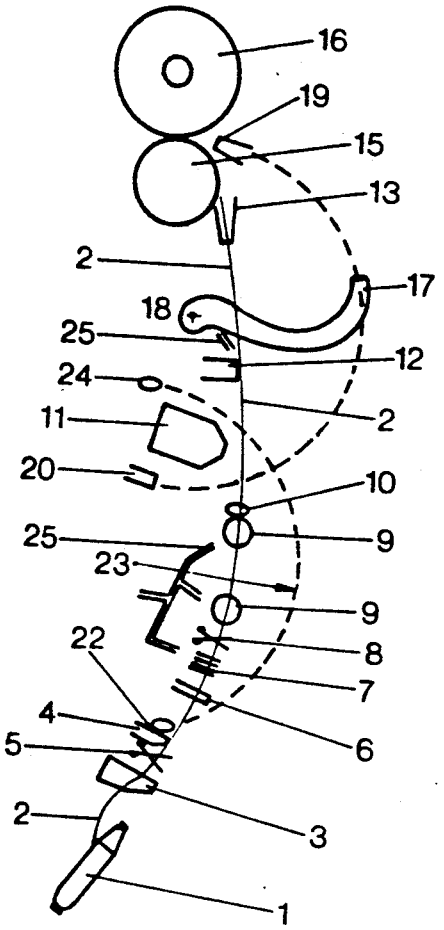
FIG. 1A is a schematic side view of the device.
Figure 1B:
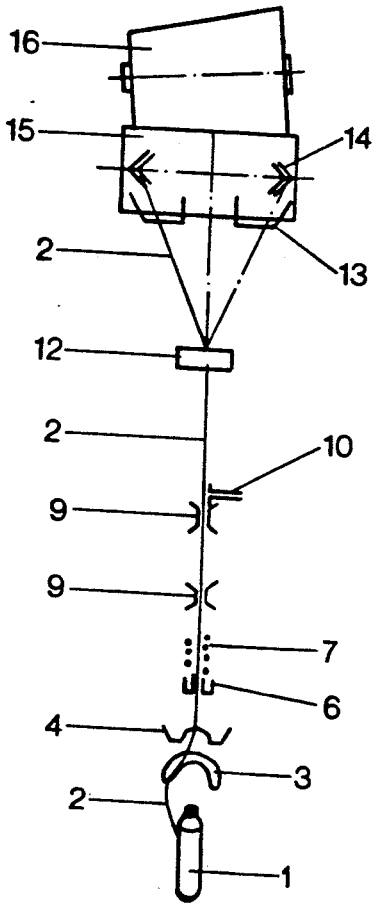
FIG. 1B is a schematic front view of the device.
Figure 5:
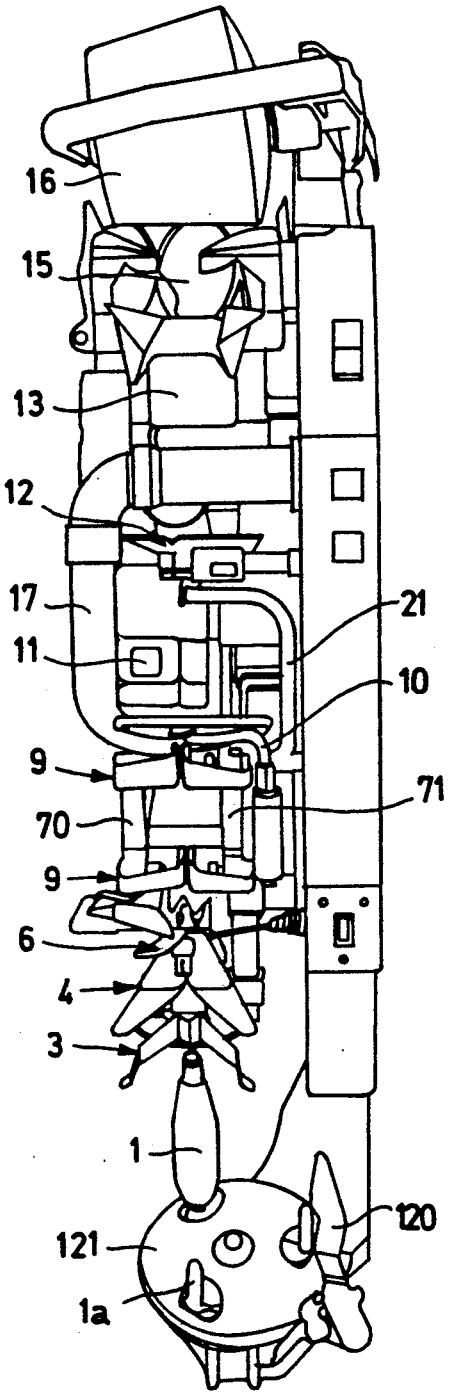
FIG. 5 is a front view of the device.
Figure 9:
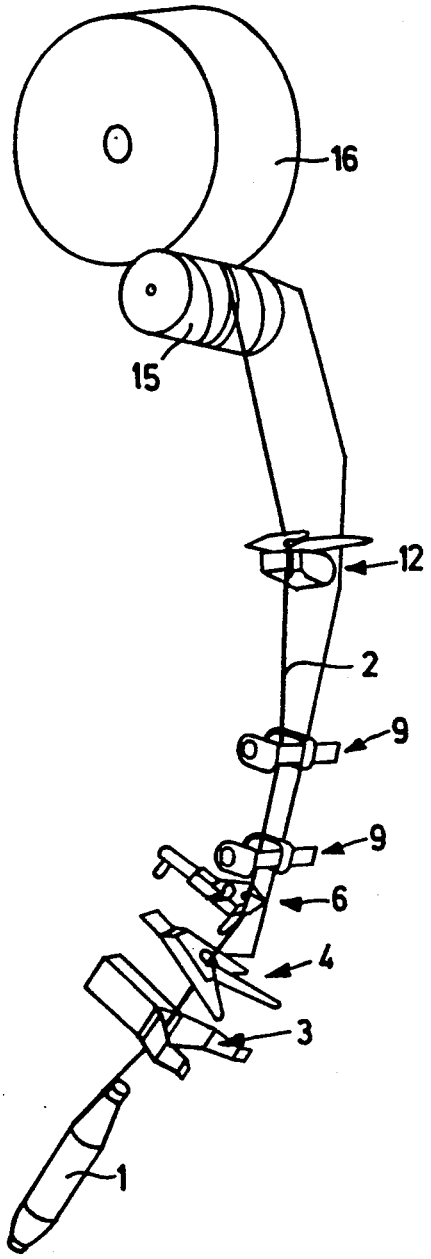
FIG. 9 is a perspective view of the device illustrating the thread path.

The equipment pieces which constitute the device and which accomplish the process according to the invention are schematically shown in the practical embodiment of FIGS. 1A and 1B, which respectively show a side view and a front view of a thread route. The feeding spool 1, installed on an expandable pin 1A shown in FIG. 5 supplies the thread 2 which unwinds according to a spiral commonly called "the balloon". The thread meets the balloon-breaker 3, which contains and limits the amplitude of the balloon, and then the thread guide 4 which defines exactly the position of the thread at the entrance to the threaded guided route.

Figure 6:
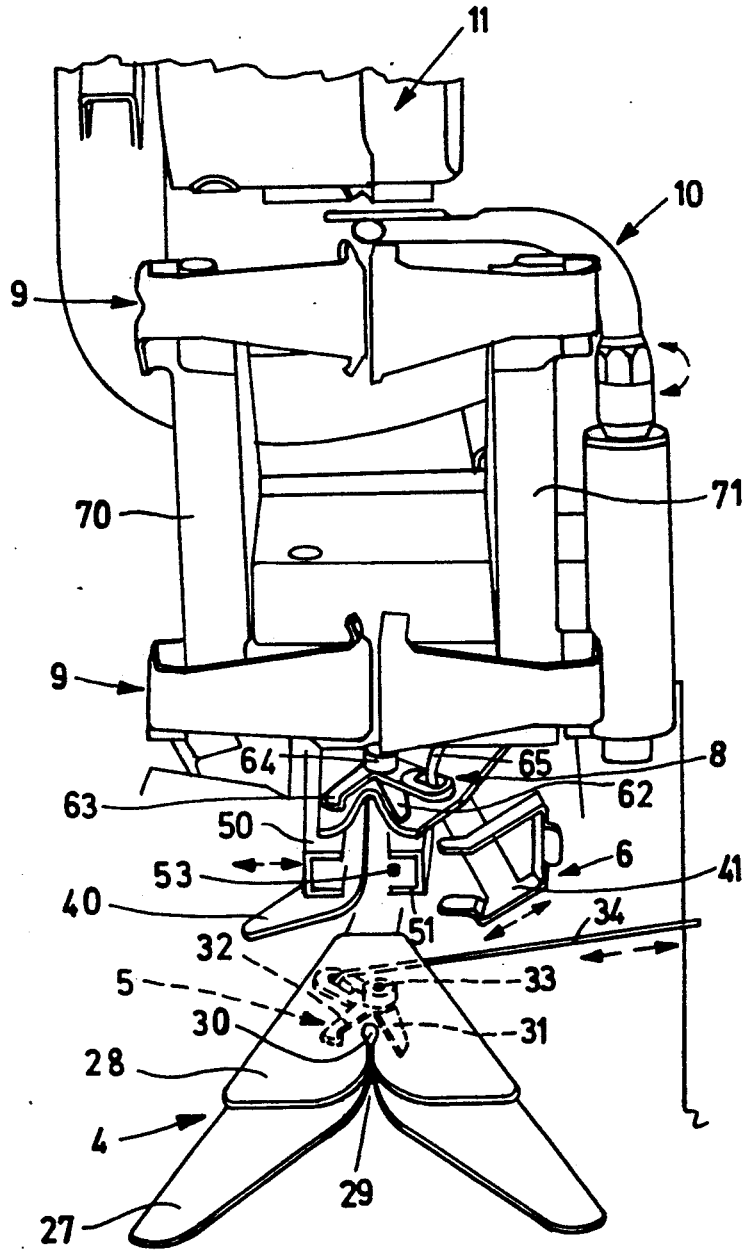
FIG. 6 is a front view of the lower part of the device on an enlarged scale.
Figure 8A:
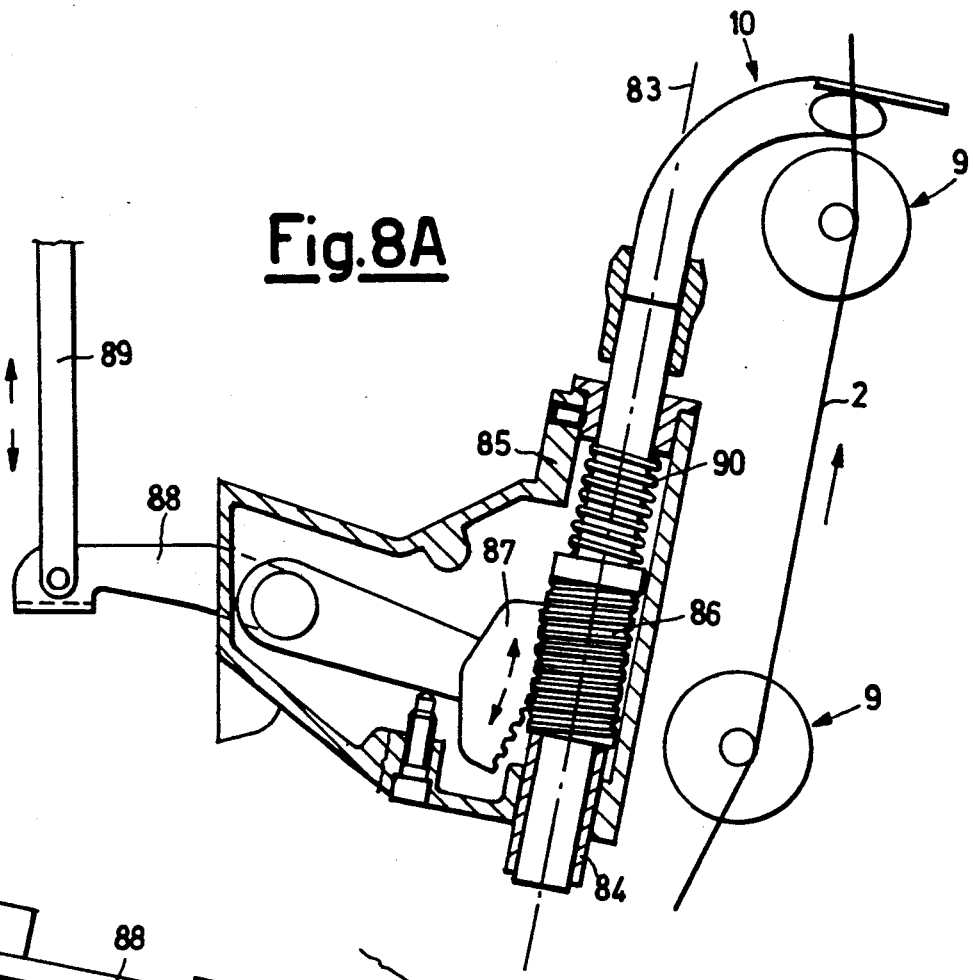
FIG. 8A is a partially sectioned side view of a thread tensioning nozzle of the device.
Figure 8B:
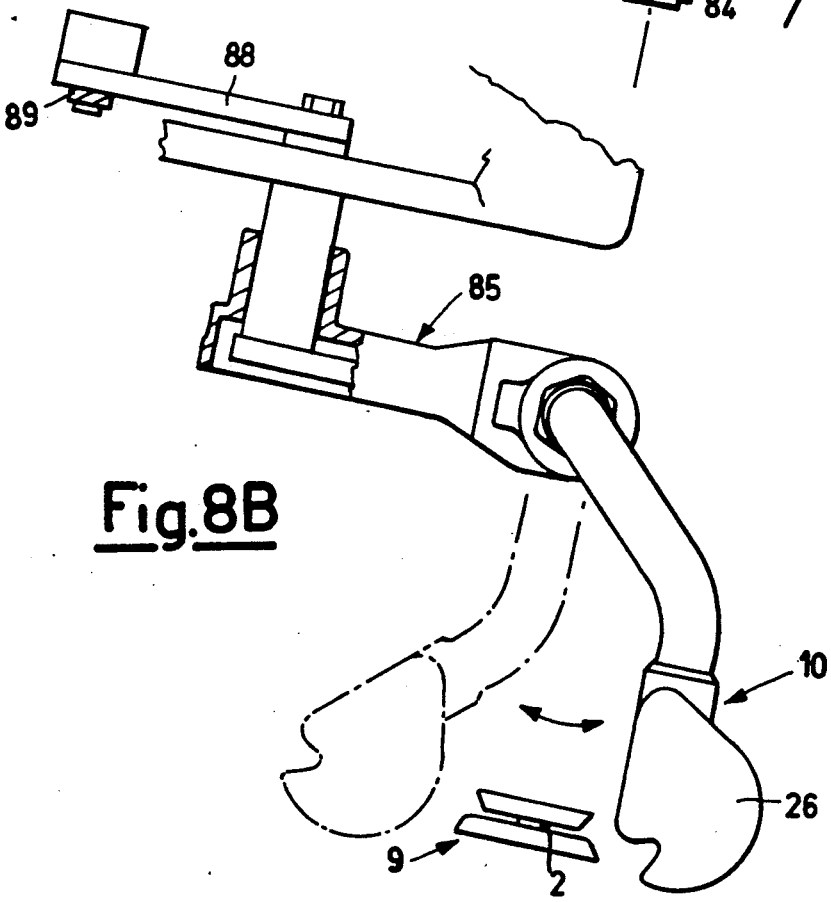
FIG. 8B is a top plan view of the nozzle of FIG. 8A.

Between the balloon-breaker 3 and the thread guide 4 a cutting device 5 is interposed (see also FIG. 6), which is symbolically indicated in FIG. 1A with a pair of scissors, but which can have a whatever configuration. It is operated by means well known in the art, for example by a lever mechanism with tie rods controlled by a cam, as will be seen later on.

The thread 2 finds then, along its upwards route, a pre-slub catcher 6, which is generally constituted by a slit of adjustable and preset size, for holding the clots or the coarsest imperfections, by tearing the thread. In this case, the point wherein the interruption of the thread occurs cannot be determined a priori, in that it necessarily occurs above the preslub catcher 6 due to the pulling by the upper winding-up device, and corresponds to the weakest portion of the overhanging thread. Its position, as well as the length of the free thread ends formed are hence whatever. The thread 2 meets—after the pre catcher 6—the thread feeler 7, which is constituted by a detector device for the thread presence. Said thread feeler 7 must "feel" the stationary thread at the beginning of the handling intervention cycle. Both the pre-slub catcher 6 and the thread feeler 7 are operated by means well known in the art. For example, they can each be controlled by a pneumatic cylinder and piston arrangement operated by a control valve which is operated by a cam as will be seen in more detail later on.

In the absence of a thread, the requested intervention is that of spool change and of thread joining; in the presence of the thread, on the contrary, a joining intervention only is requested. The device 7 is hence that which determines the type of action to be undertaken, and hence the sequence of operations to be carried out.

The thread 2 finds then, along its upwards run, a further cutting device 8 also here symbolically indicated in FIG. 1A by scissors. Means like those for controlling cutting device 5 may be employed for operating cutting device 8.

The thread 2 meets subsequently a thread tensioner 9. Such thread tensioner device performs the function of giving the same thread a tension adjustable and ranging within preset limits, so to secure a regular cone winding-up. The thread tensioner performs also the auxiliary function of eliminating the weak thread lengths.

The thread tensioner device can be embodied with one or more tensioning sections, generally constituted by pairs of co-axial washers opposite to each other and urged against each other. Means like those for controlling the pre-slub catcher 6, the thread feeler 7, and the cutting device 8 can be employed to operate the thread tensioner 9 as is well known in the art.

A thread tensioner device capable of maintaining such tension also in the presence of irregularities in the thread is the object of the same Applicants' U.S. Pat. No. 4,809,927.

The thread tensioner device 9 is followed by the suction nozzle 10.

Such suction nozzle is one of the basic components of the device, and in the process according to the present invention the nozzle 10 performs the following functions:

a) it catches the free thread end when the slub catcher 12 detects an irregularity in the thread and commands the cutting. It holds the free thread end and keeps it in a controlled position for the subsequent operations. During such step, the nozzle 10 intakes both the upper free thread end coming from the slub catcher 12, and a thread length coming from underneath the same nozzle 10, contained inside the tensioner device 9, which, subsequently to the action of the slub catcher 12 opens. The nozzle 10 thus intakes also the dust, the clots and the flocks which have possibly accumulated inside the thread tensioner 9. In this way, the suction nozzle first catches the cut length of thread from the area between the slub catcher 12 and the nozzle 10. The nozzle 10 intakes this thread portion, which lies beneath the tensioner 9 and proximate to the slub catcher 12, either when the tensioner 9 is closed or proximate the thread feeler when the tensioner 9 is open.

Therefore, under these conditions, the thread is only cut at the slub catcher 12, and the other end of the thread length remains connected to the spool 1. (The slub catcher 12, as is known in the art, is provided with its own cutting device.) The caught thread length is then cut by the cutter 8. (The operation of the cutter 8 is further described below.) The free end portion of the cut thread length is then sucked into the nozzle 10.

The functional purpose of the nozzle 10 is to rid the thread path of any residual fibers found between the slub catcher 12 and the cutter 8. In addition, the nozzle 10 removes flacks, dust and any other undesirable fibers from the tensioner and from the other various devices found along the thread path. These undesirable fibers are also taken into the nozzle 10 by suction. Such an operation is described in detail hereunder, by referring to FIG. 2;

b) it accompanies and positions the thread end coming from the spool, inside the knotting device 11 which is installed just above the nozzle 10. Such function is disclosed hereunder by referring to FIG. 3;

c) it accompanies and controls the thread after the joining, for it to take again its normal configuration. Such function is described in detail hereunder, by referring to FIG. 4. The suction nozzle 10 is therefore subject to move in a direction perpendicular to the route of thread 2.

The thread then meets the slub catcher 12. Such a device is one of the most important components of the coner machine, and its task is of detecting the defects of the thread 2 and of cutting the thread by means of a cutting device not shown in the figures, but substantially positioned in the same position as of the slub catcher.

The thread 2 runs then upwards and meets a funnel-shaped member 13, which guides the same thread towards the thread guide slits 14 of the cylinder 15, which guide the turns of thread 2 on the cone 16.

The device is completed by further handling devices and auxiliary devices.

A suction nozzle 17—the suction end of which is given an extended shape, so that it is able to perform the sucking action through the whole generatrix of said cone—collects the free thread end from the cone side and, by moving around the center 18, reciprocates between the end positions 19 of thread catching and 20 of thread consignment to the knotting device 11.

Figure 3:
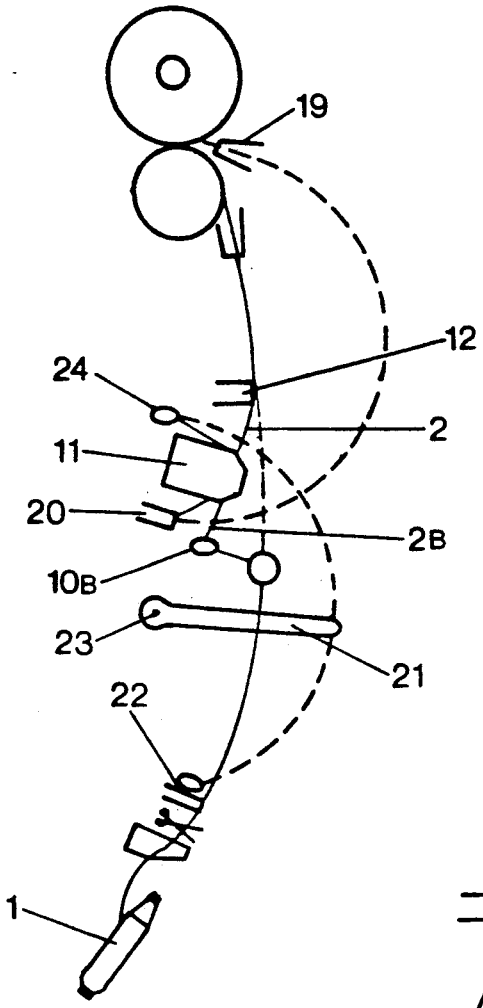
FIG. 3 is a schematic side view illustrating the operations of the device.

A further suction nozzle 21—which, for the sake of clearness in the drawing is shown in FIG. 3—collects the thread end from the side of the feeding spool 1 in an extreme position 22 and, by revolving around the centre 23, takes it to the position 24, for it to be consigned to the knotting device 11.

Therefore, the functional purpose of the nozzle 17 and the nozzle 21 is to catch the thread ends which respectively lie at the side of the cone 16 and at the side of the spool 1. These caught thread ends are then brought to the knotting unit 11 by these respective nozzles.

If a length of thread happens to remain between the cutter 8 and the cutter 5, this remaining thread length is caught and sucked in by nozzle 21. This is shown as position 22 in FIGS. 2 and 3.

Figure 4:
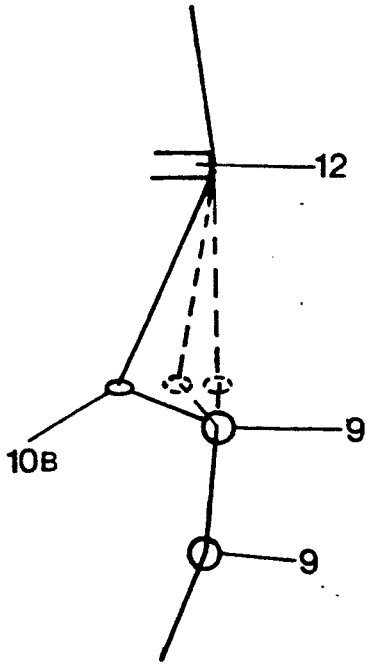
FIG. 4 is a schematic side view illustrating the operations of the nozzle of the device.

On the other hand, the nozzle 10 first cleans the region between the slub catcher 12 and the cutter 8 of undesirable fibers, and then accompanies and positions the thread ends which were caught by the nozzles 17 and 21, toward the knotting unit 11. This is shown in FIG. 3. The nozzle 10 further accompanies the knotted thread back to the normal running position. This is illustrated in FIG. 4. Nozzles 10, 17, and 21 can all be controlled in a manner well known in the art. The movement of the nozzles 17 and 21, along the indicated arcs of circles, for example, each can be controlled by a toothed rod engaging an arcuate toothed portion provided on the respective nozzle arm adjacent to the pivoting center, the toothed rod being operated by a tie rod or plural tie rods receiving movement from a cam. See, for example, U.S. Pat. Nos. 2,733,870 and 2,769,599 by Furst.

A preferred embodiment of means for controlling nozzles 10, 17, and 21 will be described later on.

Said suction nozzle 21 can—according to a preferred form of practical embodiment—be provided in its end portion with a catching cover, which holds the thread by clamping it between the cover and the nozzle edge. This contrivance secures a reliable catch also of short-length thread ends, which otherwise would not be reliably caught by the suction effect alone, and allows furthermore economies to be accomplished in the suction. The devices which are in contact with the thread—such as, e.g., the slub catcher 12, the thread tensioner 9, and the thread feeler 7—are maintained clean by means of the pressurized air jet ejected from the nozzles 25.

The above described components and the means for operating the same will now be described in more detail on the basis of a preferred constructional embodiment shown in FIGS. 5 to 18.

The thread guide 4 is constituted of plate members 27 and 28 (FIG. 6) defining a slot 29 for thread insertion, and an aperture 30 for the thread 2.

The cutting device 5 comprises a fixed blade 31 and a moveable blade 32 (FIG. 6), arranged below the thread guide 4. The moveable blade 32 is pivotable about a pin 33 and is operated by a rod 34 linked to a follower lever 35 (FIG. 17) pivoted at 36 to a fixed axis and engaging a cam 37 fastened on a cam shaft 38 (see also FIG. 16). Rotation of the cam 37 thus causes the cutting device 5 to become operative, as will be seen later on. The cam shaft 38 is rotatably supported in the winding head 39.

The pre-slub catcher 6 comprises a fixed portion 40 and a moveable portion 41 (FIG. 6 and FIG. 11), which is pivotable about an axis 42 to open the pre-slub catcher 6 during the knotting cycle, in order to free it from any tangles and to remove therefrom dust, flocks, and clots which are retained thereby during the winding operation and which are then sucked in the nozzle 10. Opening of the pre-slub catcher 6 occurs pneumatically by means of a cylinder-piston-arrangement 43 (FIG. 12) having its piston linked to the movable portion 42 of the pre-slub catcher 6. The arrangement 43 is actuated by an electrovalve 44 operated by a microswitch 45 engaged by a cam 46 of a cam shaft 47. The portion 40 of the pre-slub catcher 6 is adjustable by a fastening screw 48 engaging a slot 49 in the portion 40 to adjust the opening size of the pre-slub catcher 6 to the desired value. The cam shaft 47 is also supported in the winding head 39.

Figure 10A:
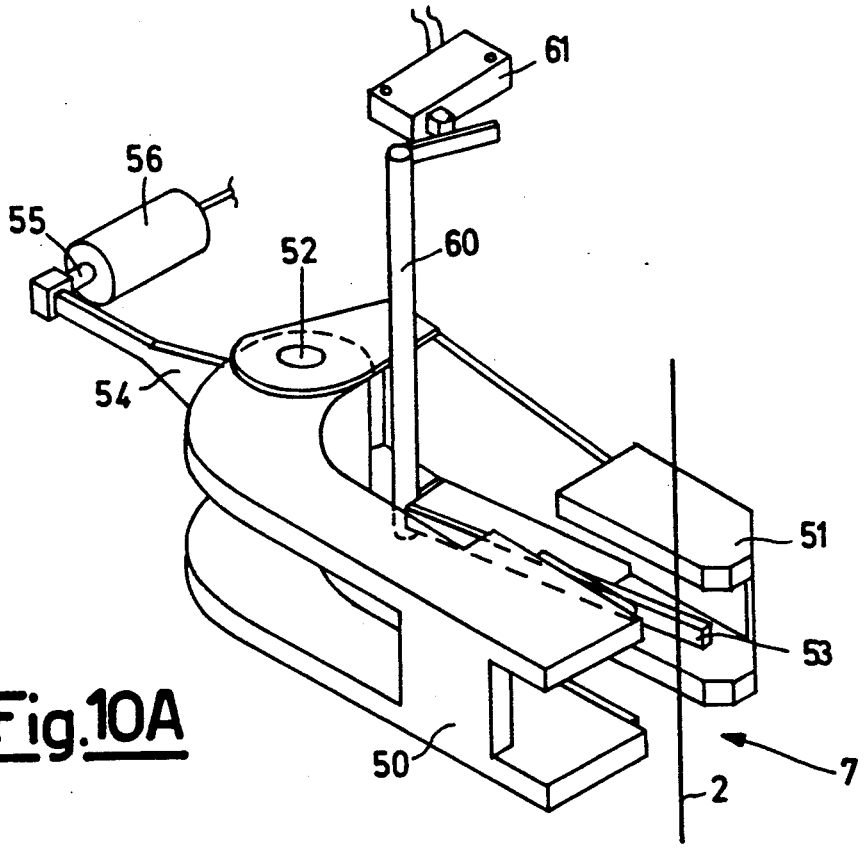
FIG. 10A is a perspective view of thread feeler in the open position.
Figure 10B:
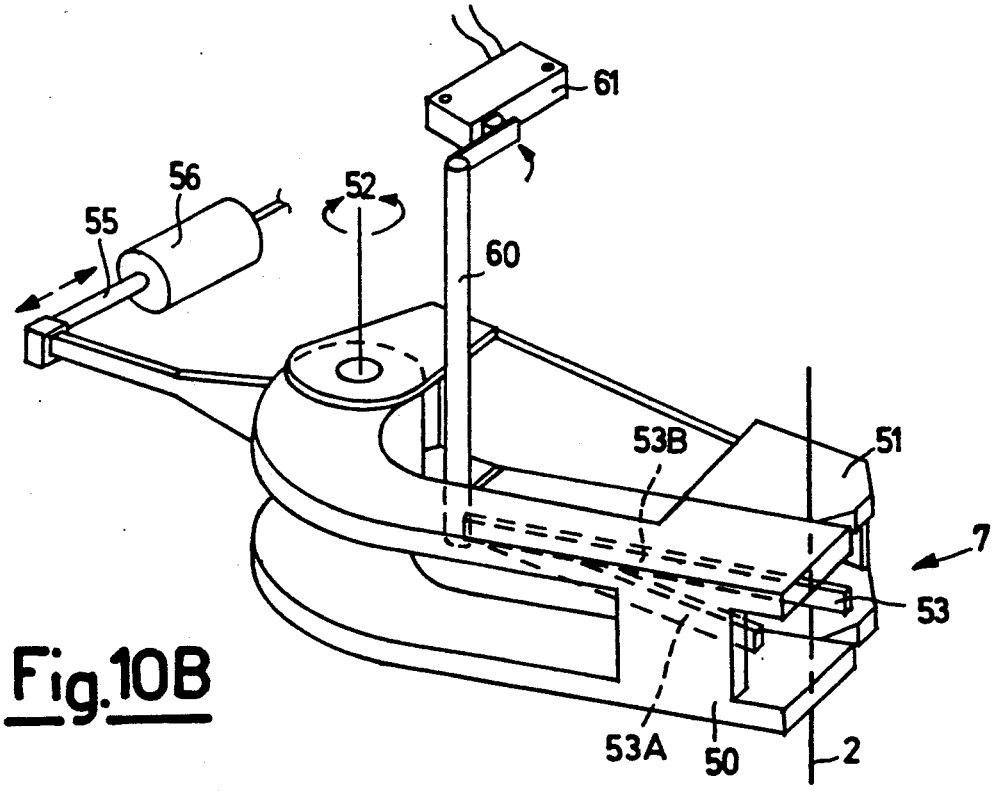
FIG. 10B is a perspective view of the thread feeler of FIG. 10A in the closed position.

The thread feeler 7 substantially comprises two jaws 50 and 51 (FIG. 10A and FIG. 10B), pivoted to each other at 52, and a thread sensing element 53 arranged therebetween. The jaw 50 has an appendix 54 to which a piston rod 55 is linked, which is operated by a pneumatic cylinder 56 controlled by an electrovalve 57 actuated by a microswitch 58 operated by a cam 59 of the cam shaft 47, so as to bring the jaws 50 and 51 in an approached position as shown in FIG. 10B. The jaw 50 is first caused to approach the jaw 51 and upon engaging the same the whole feeler 7 is further pivotally displaced. The thread 2 is so caused to engage the feeler element 53, causing the latter to rotate into the position 53B about an axis defined by a shaft 60 to open a feeler switch 61. This indicates that the thread 2 is present. On the contrary, if the thread is not present, the feeler element 53 remains in the position indicated at 53A in FIG. 10B, and the switch 61 is closed, so indicating that no thread is present and activating the spool change operation, as will be seen later on. In the open position of the feeler 7 the jaw 51 is maintained in the position shown in FIG. 10A by a stop member not shown and by a spring, also not shown, urging the jaw 51 against said stop member.

The cutting device 8 substantially comprises (FIG. 6) a fixed blade 62 and a moveable blade 63, which is pivoted about a pin 64. The moveable blade 63 has an end linked to a tie rod 65 which is actuated by a pneumatic control 66 (FIG. 12) in the form of a cylinder and piston which is controlled by an electrovalve 67. The latter is operated by a microswitch 68 which is opened and closed by a cam 69 fastened to the cam shaft 47.

The thread tensioner comprises, in the embodiment shown in FIGS. 5, 6, 7A, and 7B, two thread-tensioning section 9, which are mounted on supports 70 and 71. Each of the sections has a pressure washer 72 and a counter-washer 73. The pressure washer 72 is urged against the counter-washer 73 by a spring 74 acting on a plunger 75 rigid with the washer 72 (or by pneumatic pressure acting on the plunger 75). The pressure can be adjusted by a screwable plug 76 (or by a pressure regulator), to adjust the tension of the thread 2 according to the requirements.

Figure 7A:
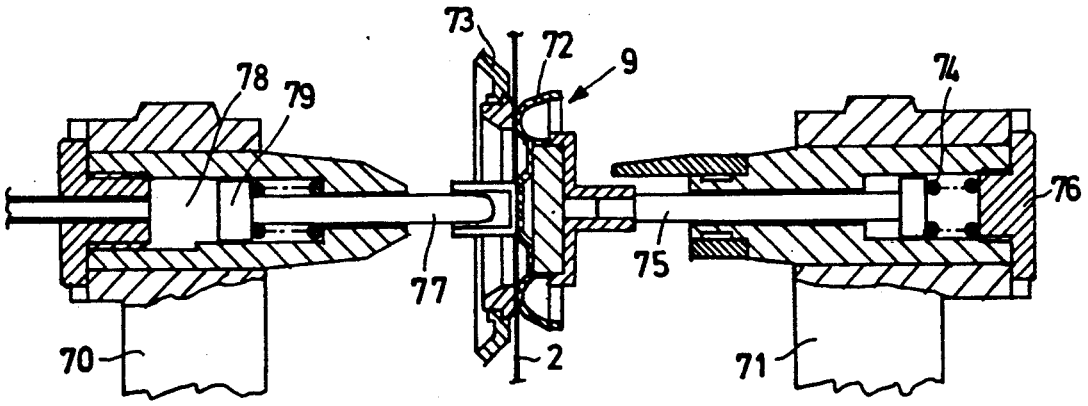
FIG. 7A is a sectional view of a thread tensioner in the closed operative position.
Figure 7B:
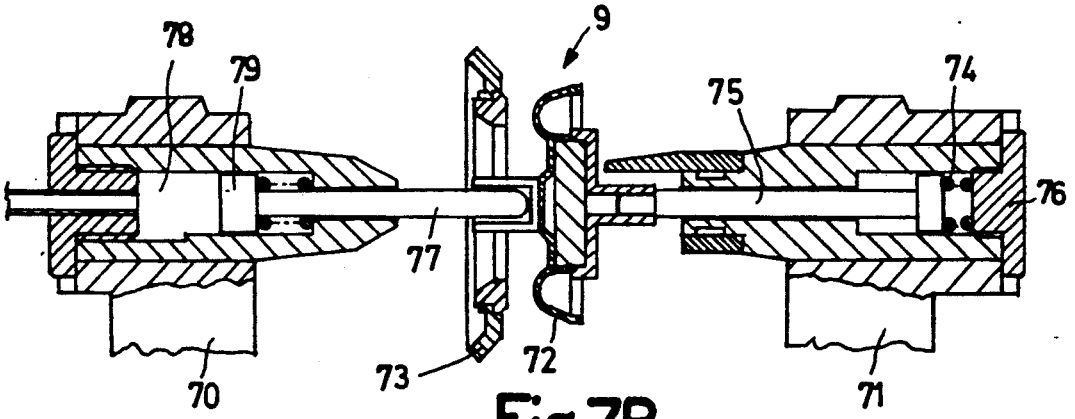
FIG. 7B is a section view of the thread tensioner of FIG. 7A in the open inoperative position.
Figure 11:
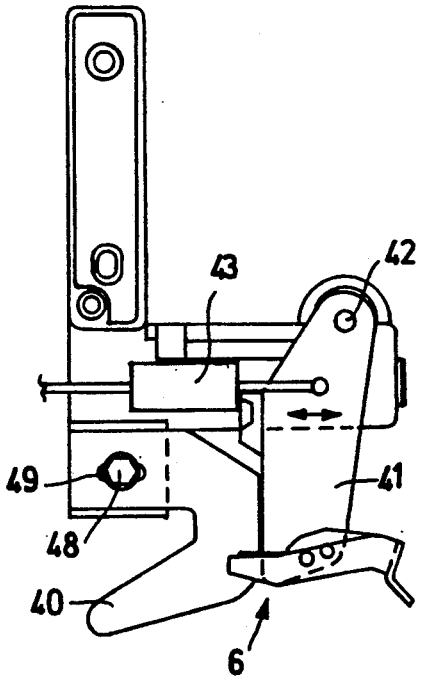
FIG. 11 is a top plan view of the pre-slub catcher.
Figure 12:
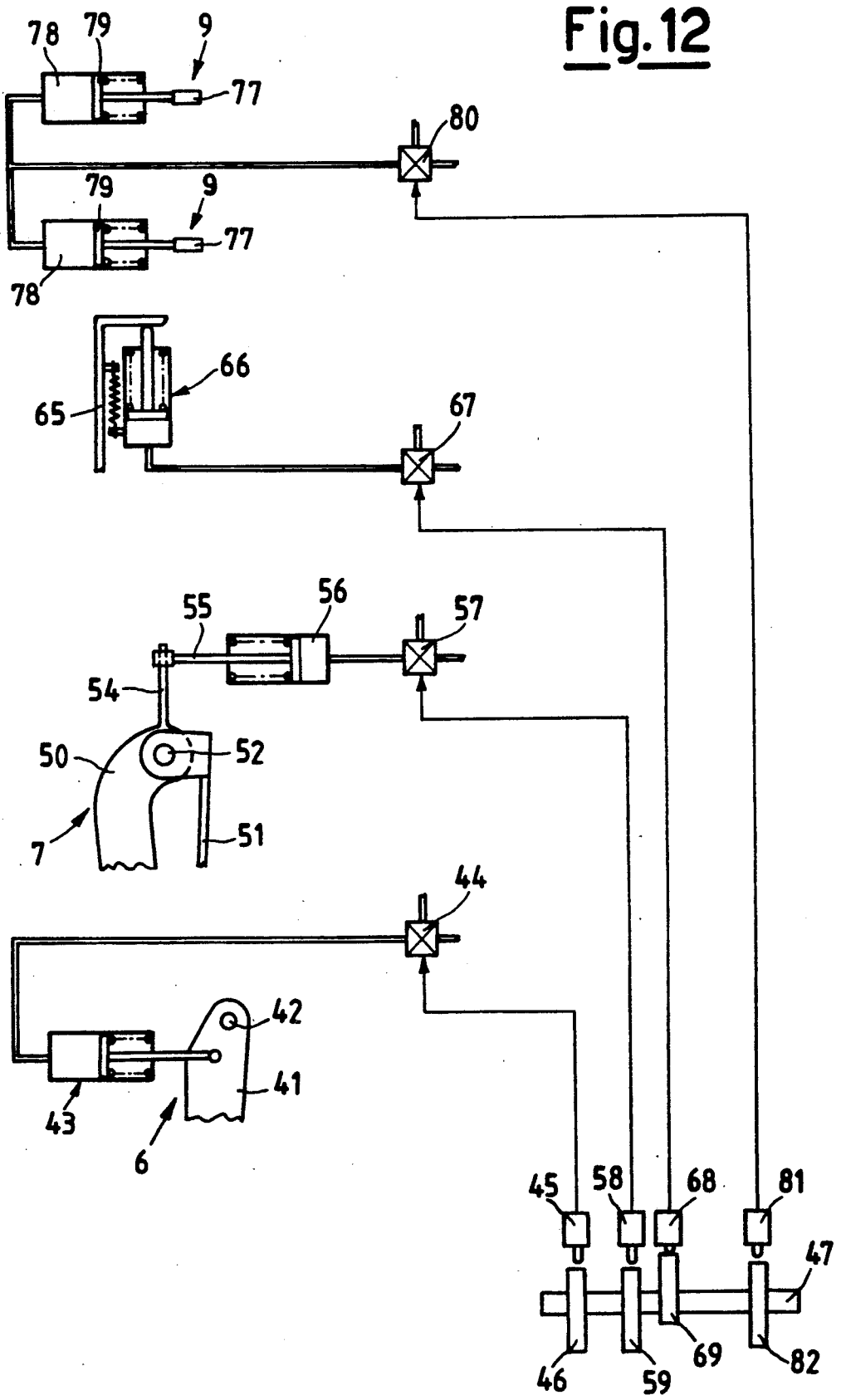
FIG. 12 is a schematic representation of the drive and control means for operating various movable members of the device.
Figure 13:
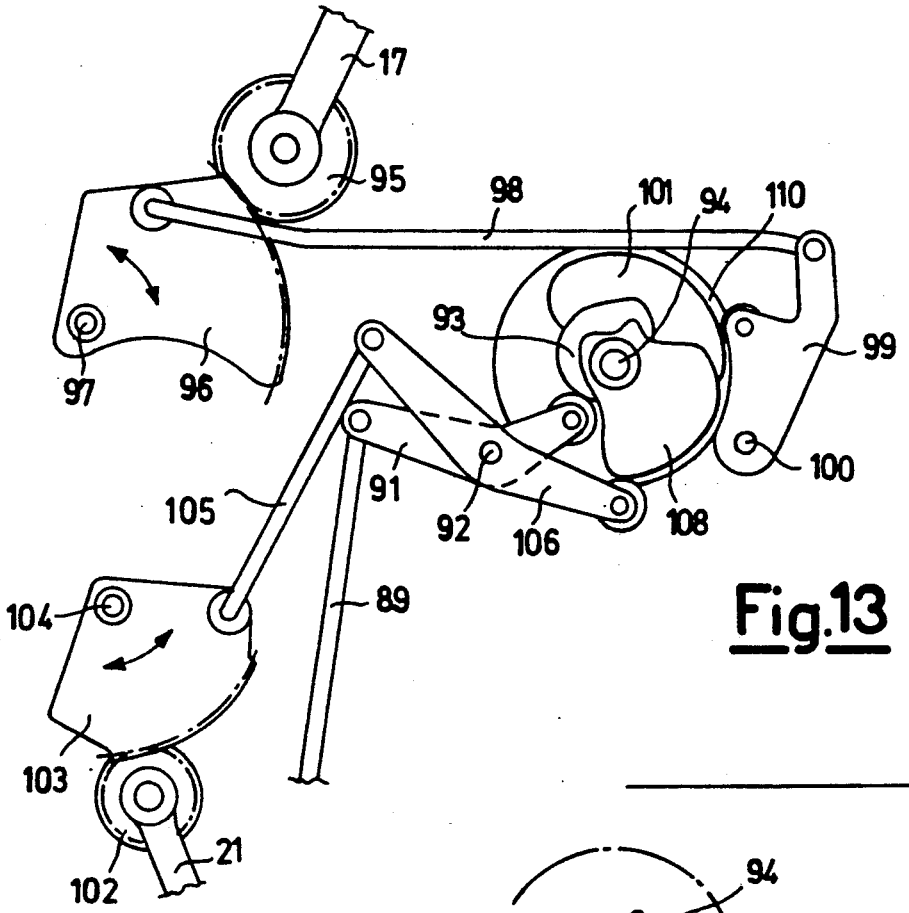
FIG. 13 is a schematic side view of the drive and control means for operating various moveable members of the device.

Under normal operation, the tensioning sections 9 are closed on the thread 2 in the position shown in FIG. 7A. At the beginning of a knotting cycle the tensioning sections 9 are opened as shown in FIG. 7B to remove dust, flocks, and knots deposited between the washers 72 and 73. These materials are sucked in by the nozzle 10. Opening is provided by a plunger 77 which engages the washer 72 and urges it away from the counter-washer 73. For this purpose a pressure fluid is conveyed into a chamber 78 in which an enlarged end 79 of the plunger 77 acts as a piston. Pressure fluid is controlled by an electrovalve 80 (FIG. 12) which is in turn actuated by a microswitch 81 operated by a cam 82 fastened on the cam shaft 47.

Figure 2A:
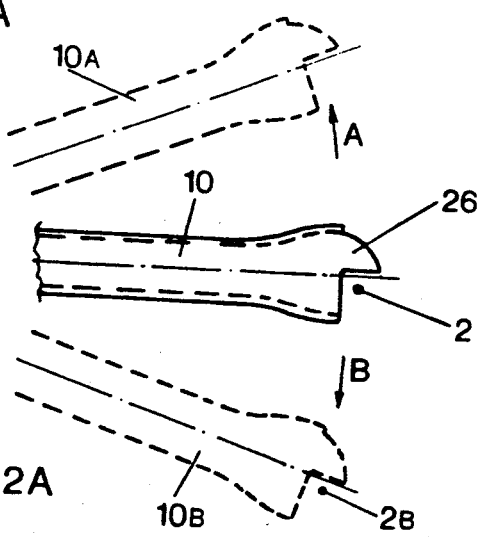
FIG. 2A is a schematic detailed view of the nozzle of the device.
Figure 2:
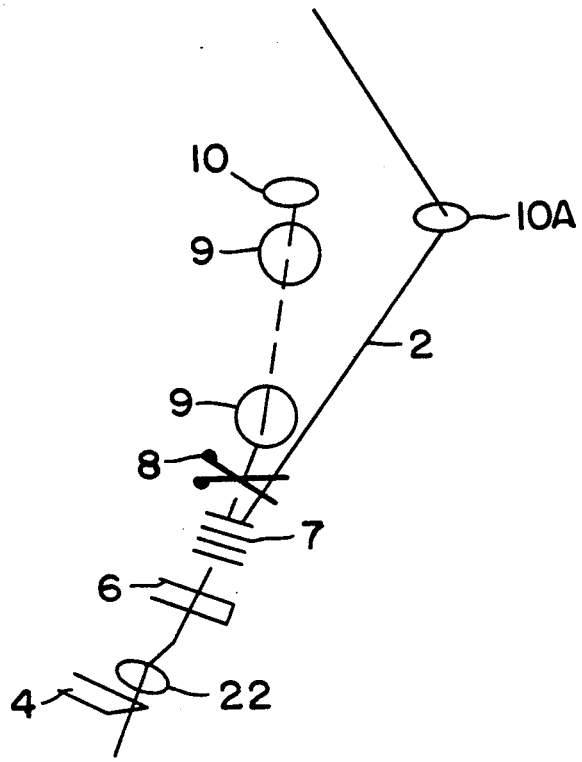
FIG. 2 is a schematic side view illustrating the operations of the nozzle of the device.

The nozzle 10 is pivotable in the plane of the path of the thread 2 as it results from observing FIGS. 2, 3, and 4, but generally transverse to the thread. The nozzle 10 is pivotable about an axis 83 (FIG. 8A) to move generally between positions opposite the thread path (see FIGS. 2–4 and 8B). The nozzle 10 is in the form of a shaped tube having an elongate portion 84 coaxial with the axis 83 and this portion is rotatably supported in a housing 85. Around the elongate portion 84 there is provided a threaded portion 86 engaged by a toothed sector 87 provided at one end of a control lever 88, the other end of which is linked to a tie rod 89. On moving the tie rod 89 in the longitudinal direction thereof, the lever 88 is caused to rock and this movement causes a rotational movement of the nozzle 10 about the axis 83 owing to the engagement between the elements 86 and 87. A spring 90 returns the nozzle 10 into its rest position facing the thread 2 upon releasing the tie rod 89.

The tie rod 89 is operatively connected to a cam follower lever 91 (FIG. 13), pivoted at 92 and controlled by the profile of a cam 93 fastened on a cam shaft 94. The profile of the cam 93 is so chosen as to cause the nozzle 10 to move between the positions 10A and 10B (FIGS. 2, 2A, 3, and 4).

The nozzle 17 is rotated between the positions indicated at 19 and 20 in a manner known per se, for example by providing a gear wheel 95 rigid with the nozzle body and coaxial with the rotation axis of the nozzle 17, the gear wheel 95 being engaged by a toothed sector 96 pivoted at 97. The sector 96 is caused to rock by a rod 98 operatively connected to a follower lever 99, pivoted at 100 and following the profile of a cam 101 fastened to the cam shaft 94.

The nozzle 21 is rotated in an analogous manner. It has a gear wheel 102 rigid with the nozzle body at the rotating axis thereof, the wheel 102 being engaged by a toothed sector 103 pivoted at 104. A rod 105 is connected at one end to the sector 103 and at the other end to a follower lever 106 pivoted at 92 and engaging a cam 108 fastened to the cam shaft 94.

Figure 17:
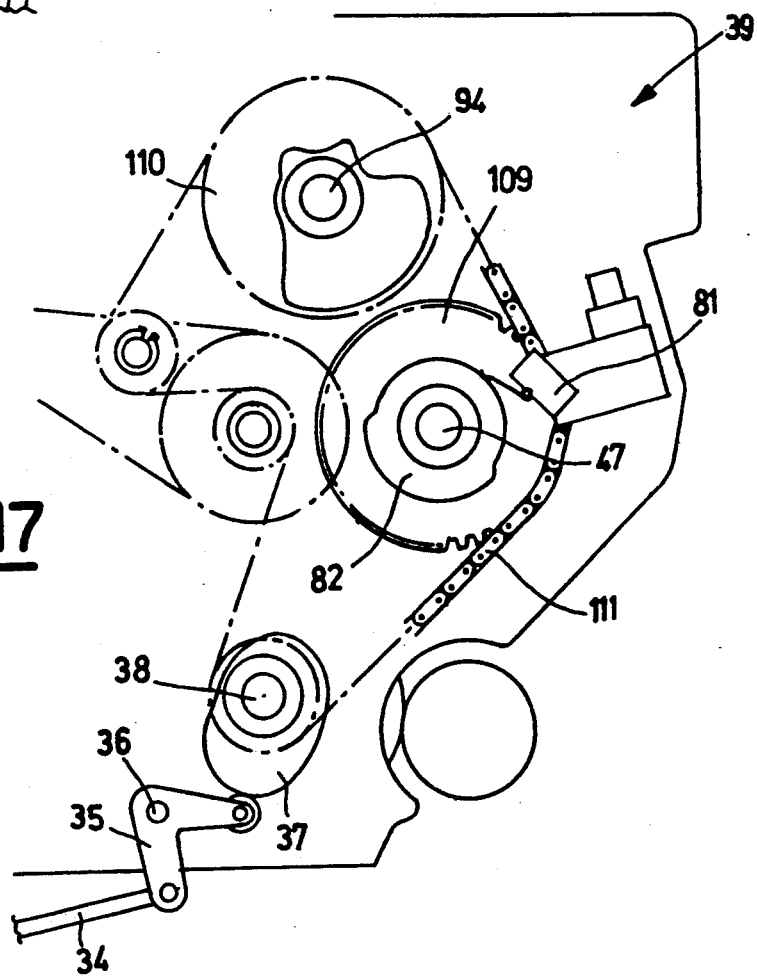
FIG. 17 is a schematic side view of the drive for the cams in the winding head.
Figure 14:
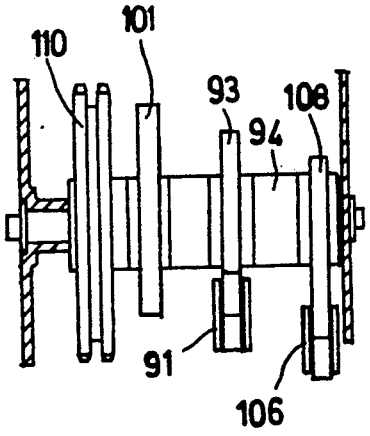
FIG. 14 is a side view of the cam means for controlling various moveable members of the device to carry out a knitting cycle in a spool change cycle.
Figure 15:
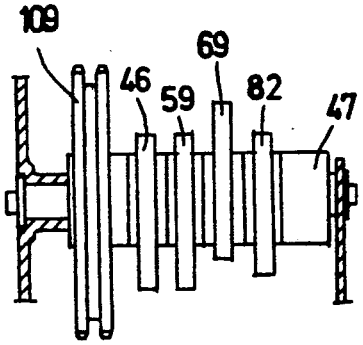
FIG. 15 is a side view of the cam means for controlling various moveable members of the device to carry out a knitting cycle in a spool change cycle.

The cam shafts 47 and 94 are each rigid with a respective chain wheel 109, 110 (FIGS. 14 and 15) and are rotatably mounted in the winding head 39 as shown in FIG. 17. A chain 111 drives the chain wheels 109, 110. The chain 111 is driven by a chain wheel 112 rigid on a shaft 113, which is caused to rotate as soon as a thread breaking is detected by the slub catcher 12. The shaft 113 is thus mechanically coupled to a continuously rotating machine shaft 114 by an electromagnetically controlled coupling 115 which is actuated by the signal coming from the slub catcher 12 which starts the knotting cycle, as explained later on.

Coaxially with the shaft 113 there is arranged the shaft 38 which besides carrying the cam 37 also carries cams 117, 118, and 119, for controlling the spool change in a manner known per se. Specifically, the cam 117 controls the catching of the thread end of the reserve spool and its retainment by a suction nozzle (not shown) in a position suitable to be caught by the nozzle 21 in the position 22. The cams 118 and 119 respectively control the expeller 120 (FIG. 5) of the empty spool and the rotation of the spool carrier plate 121 by a step, to bring the new spool 1 in the operative position.

The shaft 38 is mechanically coupled to the shaft 113 by an electromagnetically operated coupling 122 when the spool 1 is to be changed. The coupling is actuated by the microswitch 61, when this latter, as described above, senses the absence of the thread 2.

Figure 18:
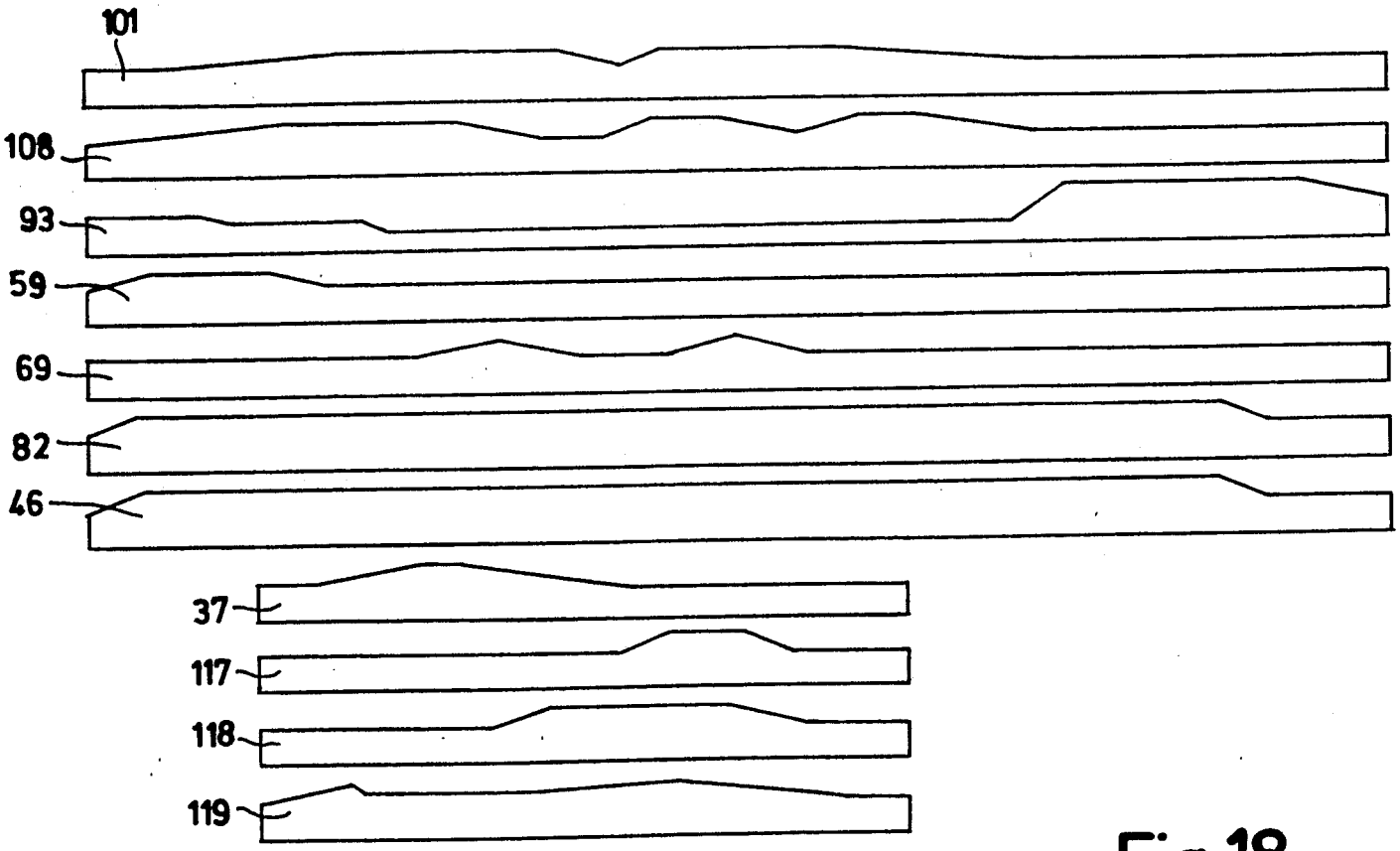
FIG. 18 shows the cam profiles developed into a plan and their mutual relationship.

FIG. 18 shows the profiles of the cams controlling the various movable members developed in a plan and also shows their mutual position which allows the various operative steps to be carried out sequentially as will now be described.

The process of thread handling by the device according to the invention, which allows considerable advantages to be attained, is now disclosed.

As already mentioned, the handling intervention is commanded by the slub catcher 12, which detects the absence of the thread.

Such a thread absence can be caused by different circumstances:

1) the slub catcher 12 has detected a defect and has caused the thread to be cut;

2) the thread tensioner 9 has caused removal of a weak point from the same thread;

3) the spool 1 contained coarse irregularities, stopped by the pre-slub catcher 6: the spool is faulty;

4) the spool is exhausted.

In the first two cases, the matter is of only intervening to join the thread; in the latter two cases, the matter is of replacing the spool and joining the free thread end of the new spool with the free thread end of the cone. Nevertheless, whether the purpose of the intervention is to join a thread because a spool need to be changed, it is the slub catcher 12 which determines and initiates the intervention cycle. This is because regardless of where the thread length has been interrupted and regardless of the reason for the interruption, the slub catcher immediately detects the absence of thread passing therethrough.

It is the thread feeler 7 which determines whether an intervention cycle should or should not also include a spool change operation. When the thread is present within the thread feeler 7, the intervention cycle does not include a spool change. On the other hand, when the slub catcher 12 determines the beginning of an intervention cycle and also the thread feeler 7 does not sense the presence of thread therein, then the intervention cycle will also include a spool changing cycle.

As soon as the slub catcher 12 signals the absence of the thread, the coning operation is discontinued.

The cone 16 and the driving cylinder 15 are preferably moved apart from each other and independently braked, in order not to damage the already coned thread. When the braking is performed, the cone and the cylinder are approached each other again.

The cycle of intervention according to the following sequence of operation is started.

Figure 16:
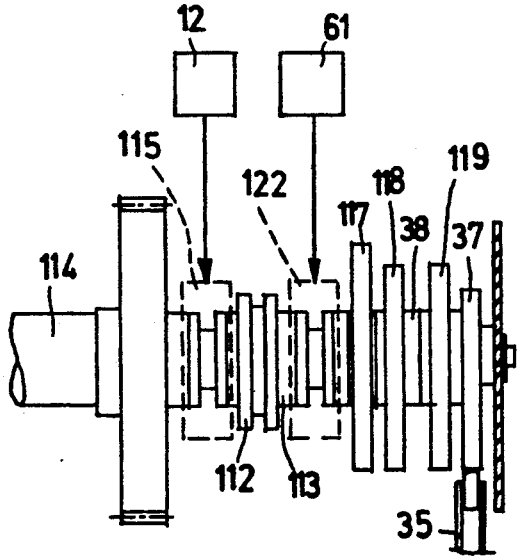
FIG. 16 is a side view of the cam means for controlling various moveable members of the device to carry out a knitting cycle in a spool change cycle.

The thread feeler 7 closes on the thread and, should this latter be absent, gives the command for spool 1 change, which is carried out simultaneously to the first steps of the knotting cycle. If, on the contrary, the thread is present, the knotting cycle only is performed. If the thread feeler 7 does not detect any thread present therein, then the microswitch 61 is activated. The activation of the microswitch 61 energizes the clutch 122 as shown in FIG. 16. By energizing the clutch 122, the cam shaft 38 is rotated. The rotation of the cam shaft 38, in turn, causes the automatic spool changing operation to occur.

After the thread feeling, the feeler 7 opens again.

The spool change is automatically carried out by the same machine, which collects the new thread end and takes it to a position, on the thread route, from which it can be collected by the nozzle 21.

For the purpose of maintaining a high operation factor of the automatic coners, the faulty spools must be replaced, like the exhausted spools. They can be processed by means of lowerproductivity machines.

For a correct handling, it is essential that all of the residual thread lengths be removed.

The nozzle 21 is placed in its position 22 already before the operation of change of spool 1.

The cutting device 5 cuts the free thread end of the spool to be discharged, the possible thread length above the cutting device 5 is intaken by the nozzle 21 and is removed.

After the cutting by the cutting device 5, the cutting device 8 is actuated, both whether the thread is present, or not.

If the thread is present, it is subdivided into two lengths, the lower of which is removed by the nozzle 21, and the upper of which is intaken by the nozzle 10.

The thread route from spool 1 up to the slub catcher 12 is now free from thread residues.

When the thread route is cleaned, the nozzle 21 is lifted according to the trajectory as shown by the short-dash line, to a position of non-interference for the change of the spool, and the presentation of the new free thread end.

It moves downwards for suction-collecting said new free thread end and holding it.

Before bringing the lower thread end to the position 24, the upper thread end coming from the cone 16 is positioned inside the knotting device 11.

This task is performed by the nozzle 17, which comes to the position 19 to collect said upper thread end from the cone 16, and then brings it to the position 20, as shown in FIG. 3.

The cylinder 15 is actuated to unwind the thread length necessary for that purpose.

The nozzle 21 brings then the new thread end to the position 24 according to the short-dash trajectory.

According to a preferred form of practical embodiment, such route is run along in two lengths, in the presence of limited-length thread ends; along a first, lifting, length some thread turns are unwound from the cone; the nozzle 21 is then lowered again, so as to such up again the unwound turns, to achieve a reliable hold, and the lifting up to position 24 is then carried out.

Before the new thread end is brought to position 24, the suction nozzle 10 has performed the functions as disclosed under (a) above.

They are now disclosed by referring to FIG. 2, which shows a side view.

The nozzle 10, shown in its normal position, after sucking up the thread ends and after the opening of the thread tensioner 9 and of the pre-slub catcher 6, moves to its advanced position 10A, and with the suction being continued, it extracts any dust and flock clots possibly accumulated in other devices.

When the nozzle 10 has come to its advanced position 10A, the nozzle 21 leads the thread end to the position 24.

Now, the nozzle 10 moves back from its advanced position 10A to the retracted position 10B of FIGS. 3 and 4, meeting the new thread end 2 and inserting it into the thread joining unit 11.

The thread joining unit 11 can be constituted by a mechanical knotting device, as well as by a pneumatic or friction joining device, as required.

In order to facilitate such operation, the hold of the thread end 2 is secured not only by the suction action, but also by an extension 26, which leads the thread to the position 10B.

The two thread ends are thus positioned inside the knotting device 11 and the knotting is carried out, with the nozzle 10 being kept in its position 10B. Before carrying out the joining, both the thread tensioner 9 and the pre-slub catcher 6 are closed again.

When the knotting is ended, the thread is released from the knotting device 11, but such a release is accompanied by the nozzle 10, which controls it by means of its extension 26, moving gradually back from the position 10B to its normal position, and thus preventing loops from being formed.

In any case, the return of the nozzle 10 from its position 10B must not occur before the coning is resumed.

The intervention cycle without spool change is now described.

When the thread feeler 7 signals the presence of thread therein, that signal means that the free end of the thread portion (which is connected at its other end to the spool 1) is located at some indeterminate position above the thread feeler 7. The position of this free end is indeterminate because the length of thread may have been interrupted for several reasons. For example, the length of thread may have been cut by the slub catcher 12, it may have been broken at a weak point when it reached the tensioner 9, or it may have broken due to some unforeseen reason.

If the length of thread has been interrupted by the slub catcher 12, then the free end of the thread located above the slub catcher is caught by the nozzle 17. Similarly, if the length of thread has been interrupted by the slub catcher, then the free end of the thread located below the slub catcher is caught by the nozzle 10. The nozzle 17 and the nozzle 10 then bring their respective caught thread ends to the knotting unit 11. This is shown in FIG. 2.

However, on the other hand, if the interruption of the length of thread is not caused by the slub catcher, but is caused instead by a failure at a weak point as the thread passes through the tensioner 9, then the nozzle 10 may not be able to catch the lower thread end. The nozzle 10 may not be able to catch the lower thread end when the interruption is caused by a break at the thread tensioner because the upper free end portion of the broken thread will pass through the slub catcher due to inertia whereas the lower free end portion of the broken thread will remain grasped within the thread tensioner. When the slub catcher detects the absence of thread, the thread tensioner is activated. Therefore, when the upper free end portion of the broken thread has passed through the slub catcher, the slub catcher detects the absence of thread, and the thread tensioner is activated to open and free the lower end portion of the broken thread so that the nozzle 10 can catch the lower free end portion of the thread.

The knotting cycle takes place exactly as disclosed above, with the difference that the thread caught by the nozzle 21 is not the thread of the new spool which was replaced, but is still the thread of the same spool 1.

In that case, the cutting device 5 is kept inactive and the cutting operation is entrusted to the cutting device 8 only. The remaining operations of the cycle are those as already disclosed referring to the intervention of spool change.

As it can be observed, the present invention provides for an arrangement of equipment pieces, i.e., a thread route, which accomplishes a process for thread handling and control which removes the residual lengths, remove dust and clots collected inside the components before the continuity of the thread being restored, and, when the thread continuity is restored, prevents thread loops from forming at process resumption, by means of a moveable suction nozzle synchronized with it, which is moved along the route of the thread.

We claim:

1. A device for rejoining a thread end from a spool and a thread end from a cone through a thread tensioning means obtained from a thread passing from the spool to the cone in a continuous thread path comprising:

a) a thread feeler member positioned proximate to the spool for detecting the absence of the thread along said continuous thread path and for activating changing the spool when said absence is detected;

b) nozzle means for catching and holding the spool thread end and the cone thread end and for bringing said ends in a thread rejoining position;

c) further nozzle means for catching the thread coming from the spool, said further nozzle means being movable transverse to the thread path from a rest position adjacent the thread path into a first position away from said thread path in which said further nozzle means cleans by suction at least said tensioning means and intakes by suction free thread portions, and into a second position away from said thread path in which said further nozzle means keeps in said thread path rejoining the position said spool thread end caught and held by said nozzle means, said further nozzle means being further movable from said second position into said rest position together with the thread for preventing the formation of loops when the thread ends are joined and the passage of thread from the spool to the cone is resumed;

d) a thread joining member for receiving the spool and cone thread ends from said catching and holding means and rejoining said received spool and cone thread ends; and e) detecting means proximate to said thread joining member for detecting the absence of the thread along the continuous thread path and for activating said catching and holding means when said detecting means detects that the thread is broken.

2. A device for removing imperfections from a thread moving in a continuous path from a spool to a cone through a thread tensioning means and for rejoining the resulting thread ends comprising:

a) a pre-slub catching member positioned proximate to said spool for retaining the imperfections until the continuous thread is broken to thereby form the spool thread end and the cone thread end;

b) a thread feeler member positioned proximate to said pre-slub catching member for detecting the presence of the broken thread or for detecting the absence of thread for spool changing and for activating changing the spool when said absence is detected;

c) a first cutting member proximate to the spool and adapted to cut the spool end to thereby remove the imperfection;

d) a second cutting member positioned proximate to said feeler member adapted to cut thread downstream of said thread feeler means;

e) nozzle means for catching and holding the spool thread end and the cone thread end and for bringing said ends in a thread rejoining position;

f) further nozzle means for catching the thread coming from the spool, said further nozzle means being movable transverse to the thread path from a rest position adjacent the thread path into a first position away from said thread path in which said further nozzle means cleans by suction at least said tensioning means and intakes by suction free thread portions, and into a second position away from said thread path in which said further nozzle means keeps in said thread path rejoining position said spool thread end caught and held by said nozzle means, said further nozzle means being further movable from said second position into said rest position together with the thread for preventing the formation of loops when the thread ends are joined and the passage of thread from the spool to the cone is resumed;

g) a thread joining member for receiving the spool and cone ends from said catching and holding means and rejoining said received spool and cone ends; and h) detecting and imperfection catching means proximate to said thread joining member for catching imperfections, for detecting the absence of the continuous thread, and for activating said device when said detecting and imperfecting catching means detects that the thread is broken.

3. The device of claim 1 or 2, further comprising an upper nozzle for catching the cone thread end by suction and for bringing the cone thread end proximate to the spool thread end, and a lower nozzle for catching the spool thread end by suction and for bringing the spool thread end proximate to the cone thread end, said nozzles adapted to rotate in a substantially vertical plane.

4. The device of claim 1 or 2, wherein said further nozzle means further comprises an extension at its end for holding said caught thread end.

5. The device of claim 4, wherein said catching and holding means further comprises an extension at its end for holding the thread end to be joined by said thread joining member.

6. A method of rejoining a thread end from a spool and a thread end from a cone through a thread tensioning means obtained from passing a thread from the spool to the cone in a continuous thread path, comprising.

a) detecting the absence of the thread end along the continuous thread path and activating changing the spool when the absence is detected by a thread feeler means positioned proximate to the spool;

b) catching and holding the spool thread end and the cone thread end by nozzle means and bringing said held spool and cone thread ends in a position for rejoining said ends;

c) cleaning at least said thread tensioning means by further nozzle means and sucking up free thread portions by said further nozzle means prior to rejoining the thread ends;

d) moving said further nozzle means into a position for keeping said spool thread end in said rejoining position;

e) rejoining said spool and cone thread ends by a thread joining means;

f) moving said further nozzle means into a rest position together with the thread for preventing the formation of loops when the thread ends are rejoined and the passage of thread from the spool to the cone is resumed; and g) detecting the absence of the thread along the continuous thread path and activating said catching means by detecting means positioned proximate to said thread joining means when said detecting means detects that the thread is broken.

7. A method of removing the imperfections from a thread moving in a continuous path from a spool to a cone through a thread tensioning means and for rejoining the resulting thread ends comprising:

a) removing imperfections of the thread by a pre-slub catching means positioned proximate to said first cutting means;

b) detecting the presence of the broken thread or detecting the absence of thread for spool changing and activating changing the spool when said absence is detected by a thread feeler means;

c) cutting the thread at the spool end to thereby remove the imperfection by a first cutting means positioned proximate to the spool;

d) cutting the thread downstream of said thread feeler means by a second cutting means positioned proximate to said thread feeler means;

e) catching and holding the spool thread end and the cone thread end by nozzle means and bringing said held spool and cone thread ends in a position for rejoining the ends;

f) cleaning at least said thread tensioning means by a further nozzle means and sucking up free thread portions by said further nozzle means prior to rejoining the thread ends;

g) moving said further nozzle means into a position for keeping said spool thread end in said rejoining position;

h) rejoining said spool and cone thread ends by a thread rejoining means;

i) moving said further thread nozzle means into a rest position together with the thread for preventing the formation of loops when the thread ends are rejoined and the passage of thread from the spool to the cone is resumed; and j) catching imperfections, detecting the absence of the continuous thread, and activating the device by detecting and imperfection catching means when said detecting and imperfection catching means detects the separation of the thread.

8. The method of claim 6 or 7, further comprising the step of moving said catching and holding means backwards for feeding the thread ends to said joining means.

9. The method of claim 6 or 7, further comprising the step of returning said catching and holding means from said first position to its original position upon resuming the coning operation.

10. The method of claim 7, further comprising the step of eliminating residues of the thread from said first cutting means before placing thread in the continuous thread path from a new spool.

11. The method of claim 7, further comprising the step of advancing said catching and holding means during sucking for extracting from said tensioner and from said pre-slub catcher dust or thread ends accumulated in said device.

* * * * *